US005454309A

United States Patent [19]

Fujikawa et al.

[11] Patent Number: 5,454,309

[45] Date of Patent: Oct. 3, 1995

[54] HEAT PRINT DEVICE FOR STAMP UNIT

[75] Inventors: Toshihide Fujikawa, Nagoya; Takashi Miki, Toyoake, both of Japan

[73] Assignee: Brother Kogyo Kabushiki Kaisha, Nagoya, Japan

[21] Appl. No.: 356,899

[22] Filed: Dec. 15, 1994

[30] Foreign Application Priority Data

Dec. 24, 1993 [JP] Japan ..... 5-347877

[51] Int. Cl.[6] ..... B05C 17/06

[52] U.S. Cl. ..... 101/128.21; 101/327; 101/487; 101/127.1; 219/216; 347/171

[58] Field of Search ..... 101/327, 21, 27, 101/31, 128.1, 127, 126, 129, 487, 103; 219/216; 346/76 PH

[56] References Cited

U.S. PATENT DOCUMENTS

| | | | |
|---|---|---|---|
| 4,742,771 | 5/1988 | Heilig | 101/327 |
| 5,184,549 | 2/1993 | Imamaki et al. | 101/128.21 |
| 5,195,832 | 3/1993 | Fujikawa et al. | 101/128.21 |
| 5,205,214 | 4/1993 | Seo et al. | 101/327 |
| 5,222,431 | 6/1993 | Kawahara | 101/128.21 |
| 5,253,581 | 10/1993 | Miki et al. | 101/127.1 |
| 5,285,725 | 2/1994 | Imamaki et al. | 101/127.1 |
| 5,303,647 | 4/1994 | Seo et al. | 101/128.21 |
| 5,329,848 | 7/1994 | Yasui et al. | 101/127.1 |
| 5,400,709 | 3/1995 | Drilling et al. | 101/128.1 |

*Primary Examiner*—Eugene H. Eickholt
*Attorney, Agent, or Firm*—Oliff & Berridge

[57] ABSTRACT

In a heat print device for a stamp unit, a dummy stamp unit is mounted on the heat print device to tentatively thermally print a character array of normal characters on the heat sensitive sheet of a dummy stamp unit before a stamp unit is mounted on the heat print device to perform perforation printing of a character array of mirror characters of the normal characters on the print face portion of a stamp unit. If the character array formed on the heat sensitive sheet of the dummy stamp is satisfactory with respect to the character array, the character size, and the arrangement of the character array, the stamp unit is mounted on the heat printing device to perform the perforation print of the character array of the mirror characters on the print face portion of the stamp unit.

20 Claims, 14 Drawing Sheets

Fig. 18B

| STEP | ACTION |
|---|---|
| S1 | MEDIUM MOUNTED? |
| S2 | DISPLAY "PLEASE TAKE OUT MEDIUM" ON LCD |
| S3 | INITIALIZE HEAT PRINT DEVICE AND DISPLAY "IN PREPARATION" ON LCD |
| S4 | PRINT INPUT AND/OR EDITING |
| S5 | PREPARE AND STORE PRINT DOT PATTERN DATA |
| S6 | PRINT INSTRUCTION SIGNAL INPUT? |
| S7 | MEDIUM MOUNTED? |
| S8 | DISPLAY "NO MEDIUM" ON LCD |
| S9 | DUMMY STAMP UNIT? |
| S10 | EXECUTE THERMAL PRINT ON TAPE-SHAPED HEAT SENSITIVE SHEET OF DUMMY STAMP UNIT AND DISPLAY "UNDER HEAT PRINT" ON LCD → [END] |
| S11 | IS PRINT FACE SIZE CONFORMABLE? |
| S12 | DISPLAY "PRINT FACE SIZE ERROR" ON LCD |
| S13 | EXECUTE PERFORATION PRINT ON PRINT FACE PORTION OF STAMP UNIT AND DISPLAY "UNDER PERFORATION PRINT" ON LCD → [END] |

HEAT PRINT DEVICE FOR STAMP UNIT

BACKGROUND OF THE INVENTION

1. Field of the Invention

This invention relates to a heat-print device for a stamp unit, and particularly to a heat-print device for performing perforation-printing in a dot pattern on a print face portion of heat sensitive stencil paper of a stamp unit and performing heat-printing in a dot pattern on a heat-sensitive sheet on the surface of a platen portion of a dummy stamp unit.

2. Description of Related Art

There have been hitherto utilized various kinds of stamps, each of which serves to print a company name, an address or other character arrays on the surface of a sheet, having a print face portion formed of rubber.

These types of stamps are individually made to order. Thus, their price is expensive and an user must wait for a long time to receive the stamp after ordering.

In U.S. Pat. No. 5,285,725, the disclosure of which is herein incorporated by reference, the applicant proposed a stamping stencil which mainly contains a heat sensitive stencil paper and an ink-impregnated member which is impregnated with ink. The ink-impregnated member and a frame, surrounding the ink-impregnated member, are adhesively attached on one side to a synthetic resin film and the heat sensitive stencil paper is adhesively attached on the other surface of the ink-impregnated member and the frame.

A stamp unit comprising a stamp member and a stamping stencil is obtained by adhesively attaching the stamping stencil on the lower surface of the base portion of the stamp member, having a grip portion, through a cushion member and perforating the heat sensitive stencil paper to form a pattern, such as a character array, using a thermal head or the like.

In U.S. Pat. No. 5,253,581, the disclosure of which is herein incorporated by reference, this applicant proposed a stamp device comprising a stamp unit and a heat print device for perforating a print face portion of the stamp unit, the latter formed of heat sensitive stencil paper.

The stamp unit comprises a grip portion and a body case. A supply reel and a take-up reel are accommodated in the body case and serve to supply and wind a tape-shaped heat sensitive stencil paper. An ink pad which is part of the stamp unit, contacts the perforated heat sensitive stencil paper.

The heat print device includes a print mount portion on which the stamp unit is freely detachably mounted, a feed mechanism for feeding the heat sensitive stencil paper of the stamp unit, a thermal head for perforating the heat sensitive stencil paper of the stamp unit, a keyboard, and a controller for controlling the feed mechanism and the thermal head so that the heat sensitive stencil paper is perforated to form a character array which is input through the keyboard.

According to the stamp device, when the print face portion of the stamp unit is perforated to form a desired character-array pattern by the heat print device, ink is automatically supplied from the ink pad inside of the stamp unit to the print face portion, so that the print can be performed many times without coating external ink on the print face portion.

Further, the applicant has improved the stamp unit in the latter stamp device as described above, and is now practically implementing an improved stamp unit whose print face portion is formed of an ink-impregnated member and a heat sensitive stencil paper which is fixedly covered on the surface of the ink-impregnated member. The improved stamp unit includes a grip portion, a stamp portion fixed to the lower end of the grip portion and a print face portion (comprising an ink-impregnated member and a heat sensitive stencil paper) on the lower surface of the stamp portion.

When the print face portion of the improved stamp unit is perforated to form a character array thereon, a desired character array is not formed in a printable state when data of the character array to be input to the heat print device is defective. In this case, the stamp unit is unusable and useless.

In view of the foregoing, applicant has practically implemented a dummy stamp unit which has substantially the same shape as the stamp unit as described above and in which a heat sensitive sheet is allowed to be set up on the surface of a platen portion corresponding to the print face portion as described above. Also applicant has been practically implementing an improved stamp device in which the dummy stamp unit as described above is installed into the heat print device to conduct a heat print on the heat sensitive sheet of the dummy stamp unit prior to the perforation print of the character array on the print face portion of the improved stamp unit to verify the data.

The perforation print of a character array on the print face portion of the stamp unit is performed using a character array of mirror characters. If the heat print is also performed on the heat sensitive sheet of the dummy stamp unit in accordance with the same print data as the perforation print, the character array of the mirror letters are printed on the heat sensitive sheet. Thus there is a problem that the character array, the character size, a print state such as an arrangement of the character array, and other characteristics of the print data cannot be surely and properly determined because the mirror characters are difficult to interpret.

SUMMARY OF THE INVENTION

In view of the problem as described above, it is preferable that a character array of normal characters, not mirror characters, be thermally printed on the heat sensitive sheet of the dummy stamp unit. In this case, it is required to identify an unit installed in the heat print device (i.e., to determine whether the unit of the stamp unit or a dummy stamp unit is installed into the heat print device) and prepare print dot pattern data for printing in accordance with the identification.

An object of the invention is to provide a heat print device for a stamp unit in which each of a stamp unit and the dummy stamp unit are identified to form dot pattern data for print in accordance with the identification.

In order to attain the above object, a heat print device for a stamp unit according to the invention in which a perforation print of dot pattern is conducted on a print face portion formed of heat sensitive stencil paper in a stamp unit or a heat print of dot pattern is conducted on a heat sensitive sheet on the surface of a platen portion of a dummy stamp unit, includes a print mount unit on which each of the stamp unit and the dummy stamp unit is selectively and freely detachably mounted; input means for inputting letters, symbols and various kinds of instructions; data storing means for storing input data which are input from the input means; heat print means containing a thermal head for printing a dot pattern onto the stamp unit or the dummy stamp unit mounted on the print mount unit; identifying means for identifying whether an unit mounted on the print mount unit is a stamp unit or dummy stamp unit; and control means for controlling the driving operation of the heat print means on the basis of the input data received from the data storing means and the identification data received from the identifying means.

Here, the control means may be designed to prepare print dot pattern data with which mirror characters are printed on the print face portion of the stamp unit when the stamp unit is mounted on the heat print device while normal characters (not mirror characters) are printed on the heat sensitive sheet of the dummy stamp unit and control the driving operation of the heat print means on the basis of the prepared print dot pattern data.

According to the heat print device for the stamp unit of the invention, character array data of characters or symbols for the perforation print on the print face portion of the stamp unit are input through the input means and the input data are stored in the input data storing means. In a case where the character array is tentatively thermally printed on the heat sensitive sheet before the perforation print is performed on the print face portion, the dummy stamp unit is mounted on the print mount portion.

At this time, it is determined by the identifying means that the dummy stamp unit is mounted. The control means controls the driving operation of the heat print means on the basis of the input data from the input data storing means and the identification data from the identifying means. In this case, for example, a character array of normal characters (not mirror characters) are thermally printed. When the print state of the heat print is satisfactory, the stamp unit is mounted on the print mount unit. At this time, the mounting of the stamp unit is determined by the identifying means, and the control means controls the driving operation of the heat print means on the basis of the input data from the input data storing means and the identification data from the identifying means. In this case, a character array of mirror characters are perforated.

Further, according to the heat print device for the stamp unit of the invention, when the dummy stamp unit is mounted, the control means prepares print dot pattern data for performing a print operation With normal characters (not mirror characters) and controls the driving operation of the heat print means on the basis of the print dot pattern data thus prepared, so that the heat print operation is performed with the normal characters (not mirror characters).

Further, when the stamp unit is mounted, the control means prepares print dot pattern data for performing a print operation with mirror characters, and controls the driving operation of the heat print means on the basis of the print dot pattern data thus prepared, so that the heat print operation is performed with the mirror characters.

BRIEF DESCRIPTION OF THE DRAWINGS

FIG. 18B is a table of labels for FIG. 18A.

DETAILED DESCRIPTION OF PREFERRED EMBODIMENTS

A preferred embodiment according to the invention will be described with reference to the accompanying drawings.

Figure 16:
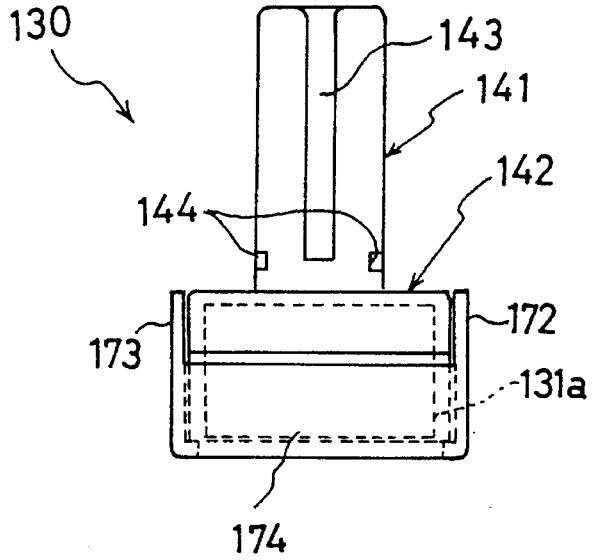
FIG. 16 is left side view of the dummy stamp unit.
Figure 17:
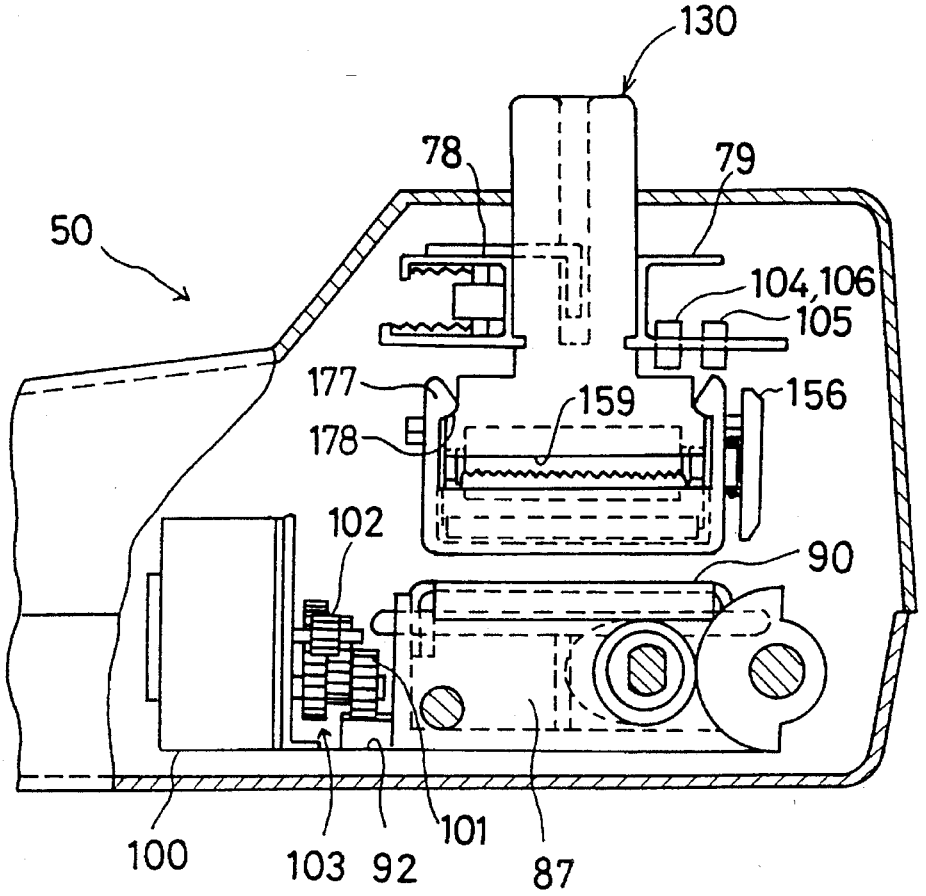
FIG. 17 is a partially cut-out, longitudinal, sectional side view showing a state where the dummy stamp unit is mounted on the heat print device.

The embodiment is applied to a stamp device comprising a stamp unit 1 (FIG. 1), a dummy stamp unit 130 (FIG. 16) and a heat print device 50 (FIG. 5) for the stamp unit for conducting a print operation on the stamp unit and the dummy stamp unit.

The stamp unit 1 has a print face portion comprising an ink-impregnated member 27 and a heat sensitive stencil paper 28. The print face portion is subjected to a heat perforation to form a desired character array in a dot pattern on the print face portion. Then it is used in the same manner as an ordinary rubber stamp.

The dummy stamp unit 130 has a heat sensitive sheet disposed on the surface of its platen portion. It is used to conduct a test heat print on the heat sensitive sheet thereof before the heat perforation is conducted on the print face portion of the stamp unit 1.

First, the stamp unit 1 of the stamp device will be described with reference to FIGS. 1 to 4. The stamp unit 1 comprises a grip portion 2 which is gripped by a hand, a stamp portion 3 which is fixedly linked to the grip portion 2, a skirt member 6 for covering the outer peripheral side of the stamp portion 3 and a protection cap 7 which is detachably mounted on the stamp portion 3.

Figure 1:
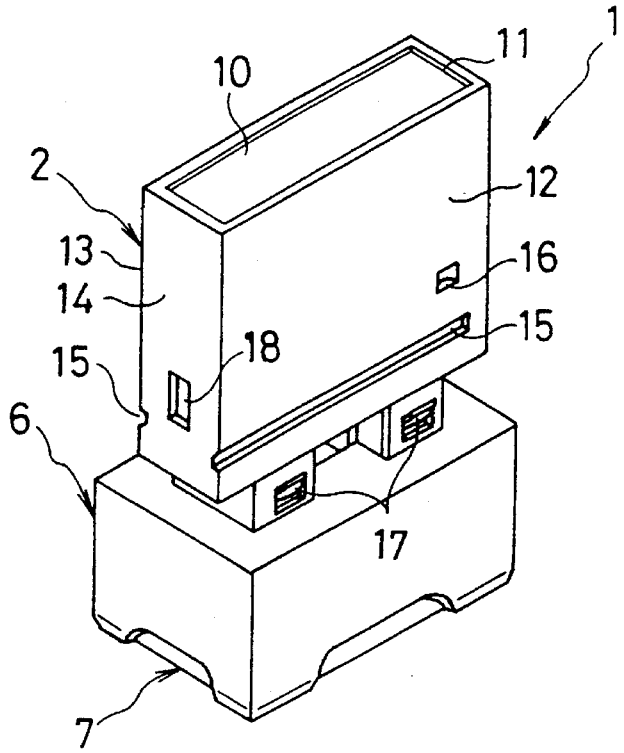
FIG. 1 is a perspective view showing a stamp unit of a stamp device according to an embodiment of the invention.

As shown in FIG. 1, a recess portion 11, to which a label 10 can be attached, is formed at the top portion of the grip portion 2, and guide grooves 15 are formed at the lower portions of the front and rear walls 12 and 13 of the grip portion 2. Further, an engaging recess portion 16 is formed on the front wall 12 and an engaging hole 18 is formed on the left side wall 14 of the grip portion 2. All directions of features are as viewed in FIG. 1.

The stamp portion 3 comprises a stamp portion body 4 and an outer periphery hold member 5 into which the stamp portion body 4 is fixedly inserted from the lower side. The outer periphery hold member 5 is fixed to the grip portion 2 through two pairs of engaging pawls 17 extending from the front wall 12 and the rear wall 13 of the grip portion 2.

The stamp portion body 4 comprises a base member 26 which has a shallow recess portion 25 at the lower surface side. An impregnation member 27, which is impregnated with an oil ink, is mounted on the recess portion 25 of the base member 26. A heat sensitive stencil paper 28 covers the lower surface of the impregnation member 27 and the outer peripheral side of the base member 26. The heat sensitive stencil paper 28 is adhesively attached to the outer peripheral surface of the base member 26 with an adhesive agent.

The base member 26 is formed of a synthetic resin or a metal material having excellent oilproof characteristics. By mounting the impregnation member 27 on the recess portion 25, positional deviation of the impregnation member 27 and leakage of the ink from the impregnation member 27 can be prevented. The impregnation member 27 is formed of a synthetic resin sponge having elasticity or of a non-woven fabric and is saturated with the oil ink. The heat sensitive stencil paper 28 is formed of a thermoplastic film, a porous supporter and an adhesive layer for adhesively attaching the thermoplastic film and the porous supporter to each other.

A portion of the heat sensitive stencil paper 28, which is closely attached to the surface of the impregnation member 27, provides the print face portion 30. The print face portion 30 extends over substantially the entire area of the lower surface of the stamp portion 3.

The skirt member 6 is attached to the grip portion so as to be freely upwardly and downwardly movable relative to the grip portion 2 and the outer periphery hold member 5. A compression spring 20 is mounted between a projection portion 29 at the center portion of the skirt member 6 and the upper wall of the grip portion 2, and the skirt member 6 is elastically urged downwardly by the compression spring 20. The projection portion 29 is formed with engaging holes 19 so that the engaging holes 19 are horizontally aligned with the engaging hole 18 when the skirt member 6 is located at the upper limit position.

The protection cap 7 is detachably mounted on the stamp portion body 4 so as to cover the lower end side of the stamp portion body 4. It is engagedly supported by the outer peripheral wall portion of the skirt member 6.

Figure 4:
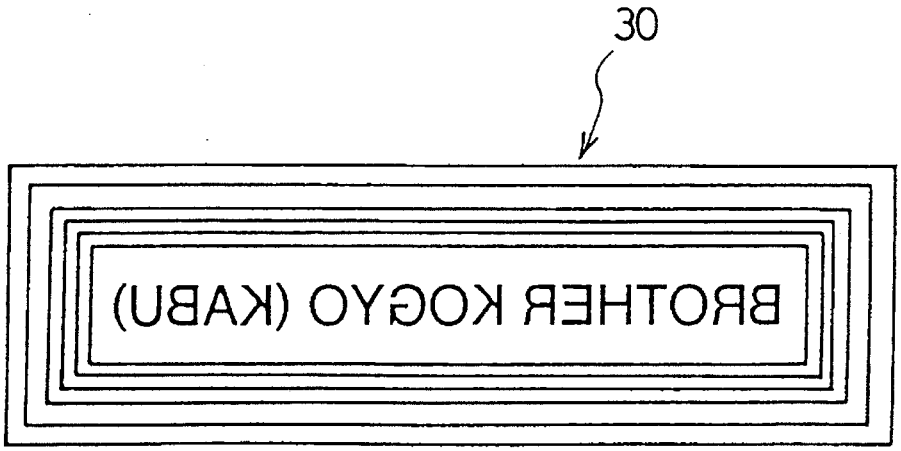
FIG. 4 is a diagram showing an example of a pattern to be perforated on the print face portion of the stamp device.

As shown in FIG. 4, many pores (dot-pattern pores) of a pattern, which is formed of a character array of mirror letters of "BROTHER KOGYO (KABU)" and sextuple rectangular frames surrounding the outer side of the character array, are formed by a thermal head 90 of the heat print device 50, thereby designing a stamp unit capable of printing a character array of a mirror image of the pattern of FIG. 4, "BROTHER KOGYO (KABU)", and the sextuple rectangular frames. Accordingly, like an ordinary stamp having a print face portion formed of rubber, the pattern as described above can be printed approximately 1000 times, for example.

Figure 3:
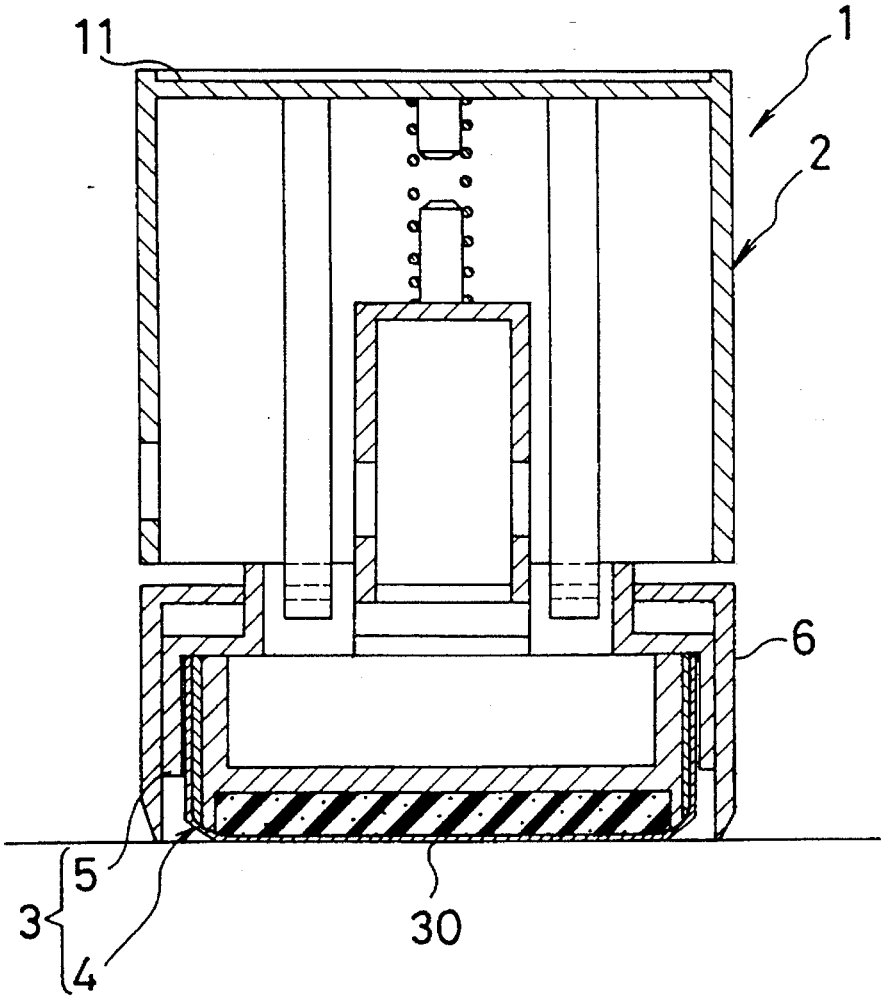
FIG. 3 is a longitudinally sectional front view of the stamp unit which shows a print state using the stamp unit.

When the heat sensitive stencil paper 28, serving as the print face portion 30, is perforated, the stamp unit 1 is mounted on the print mount portion 71 of the heat print device 50 (as described later,) and a guide bar 83 thereof is inserted through guide holes 18, 19 to keep the skirt member 6 at the upper limit position where the perforation is allowed. Further, when the device is unused, the protection cap 7 is mounted. When a print is performed, as shown in FIG. 3, the protection cap 7 is detached, and the skirt member 6 is positioned to a printing position on the surface of a sheet. After the positioning of the print face portion 30 of the stamp portion 3, the grip portion 2 is downwardly pressed to perform the print.

Next, the heat print device 50 for the stamp device will be described with reference to FIGS. 5 to 12.

Figure 5:
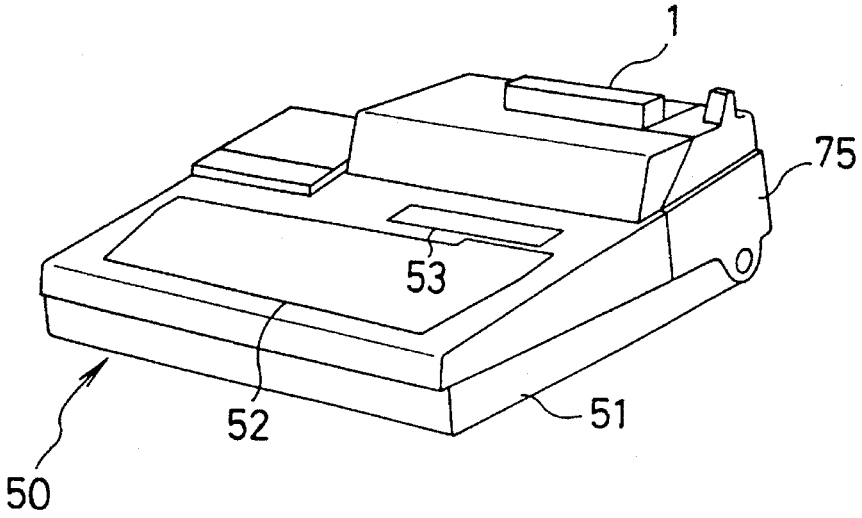
FIG. 5 is a perspective view showing the heat print device of the stamp device.
Figure 6:
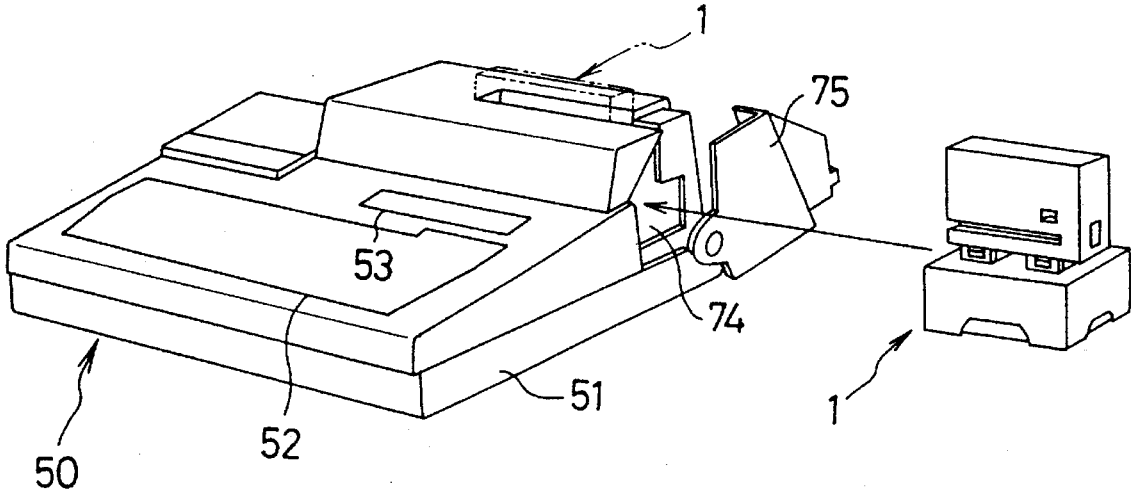
FIG. 6 is a perspective view showing the heat print device and the stamp unit.
Figure 7:
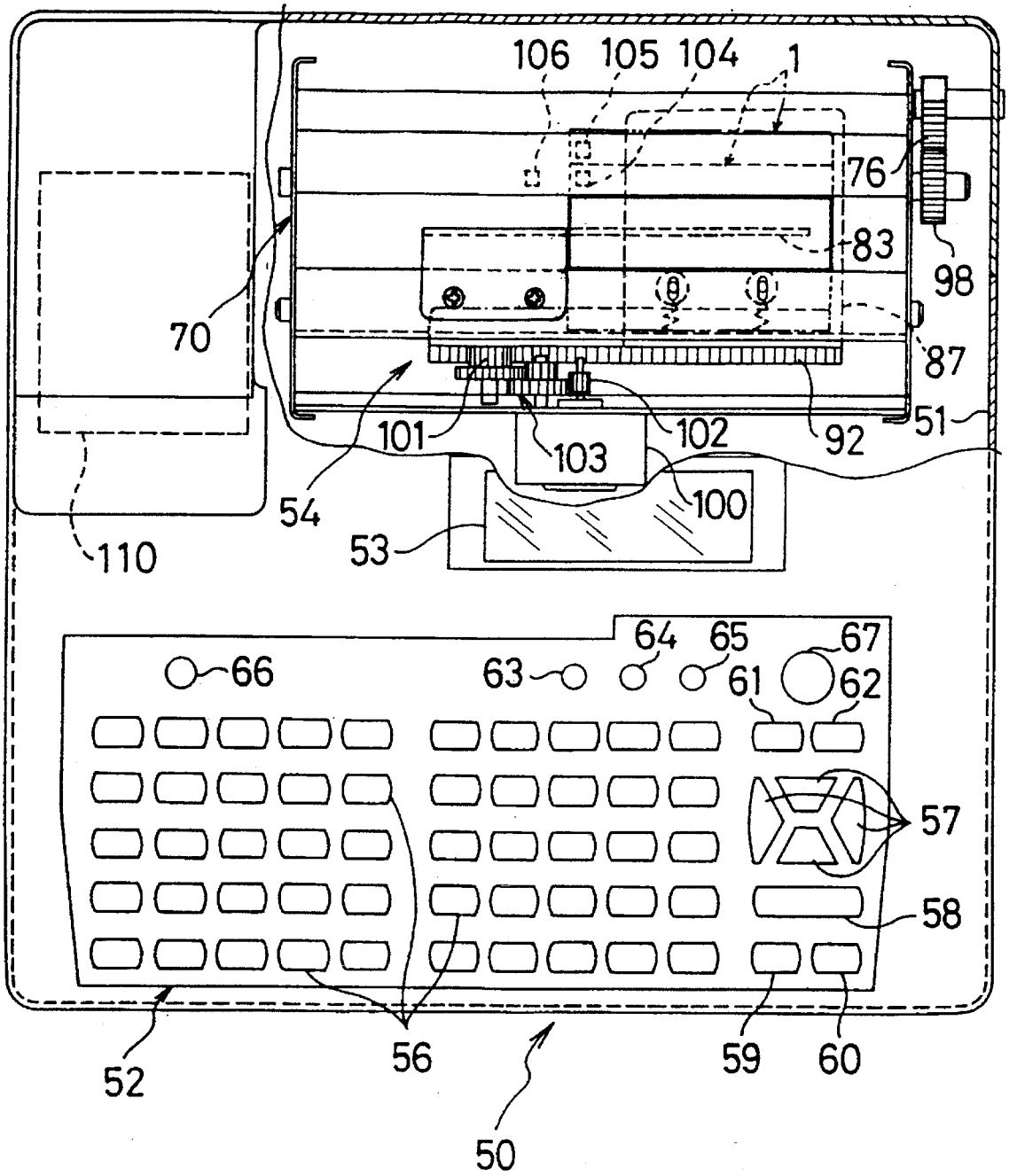
FIG. 7 is a plan view showing the heat print device.

As shown in FIGS. 5 to 7, the heat print device 50 includes a body frame 51, a keyboard 52 and a liquid crystal display 53 which are provided at the front portion of the body frame 51 (as viewed in FIGS. 5 and 6), a heat print unit 54 provided at the rear portion of the body frame 51, and a control unit 110 provided inside of the body frame 51. On the keyboard 52 are provided character and symbol keys 56 containing plural character keys and plural symbol keys, which are used for both Japanese Kana and an alphabet, and various function keys, such as cursor shift keys 57, an execution key 58, a line feed key 59, a determine/end key 60, a cancel key 61, a delete key 62, a shift key 63, a small-letter key 64, a letter kind setting key 65, a print instruction switch 66, and a main switch 67. For purposes of this application, characters are defined as letters, numbers, symbols, Kana characters and similar data inputs.

The liquid crystal display device 53 is designed to display character arrays of plural lines corresponding to a pattern which is a print target to be printed by the stamp unit 1.

Next, the heat print unit 54 will be described.

As shown in FIGS. 8 to 11, the heat print unit 54 includes a subframe 70, a print mount portion 71 on which the stamp unit 1 is detachably mounted, and a heat print mechanism 72 for perforating, in a dot form, the print face portion 33 of the stamp unit 1 mounted on the perforation mount portion 71.

Figure 9:
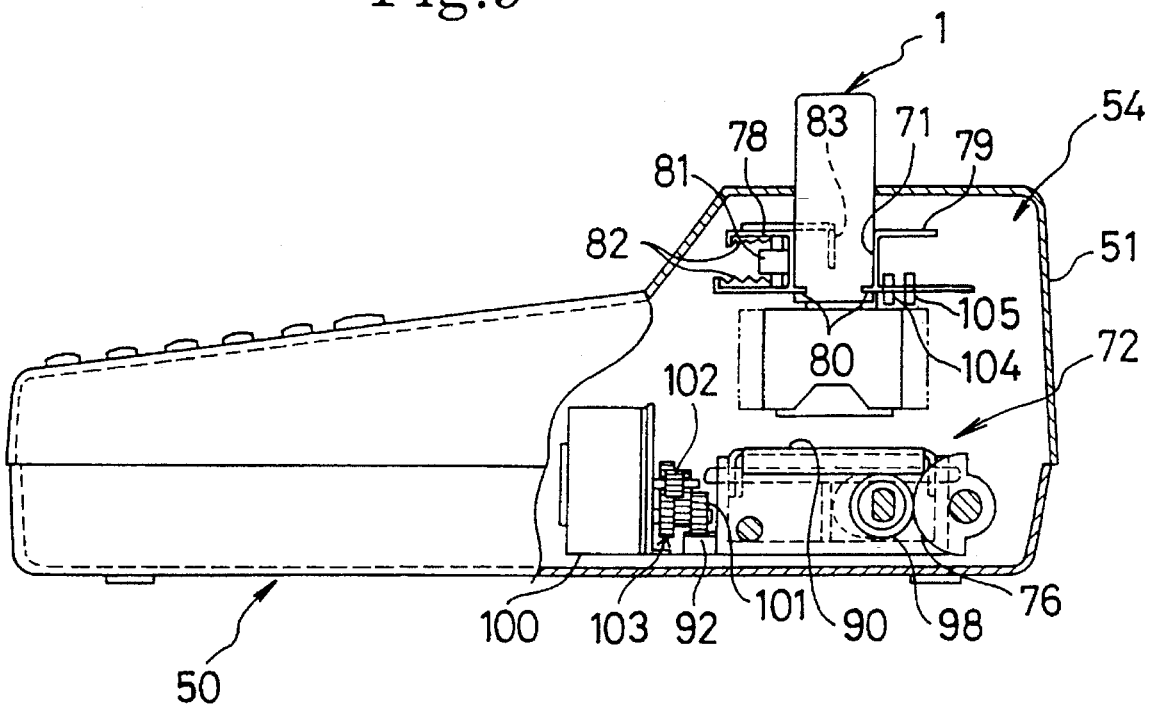
FIG. 9 is a longitudinal, partial section side view of the heat print device.
Figure 10:
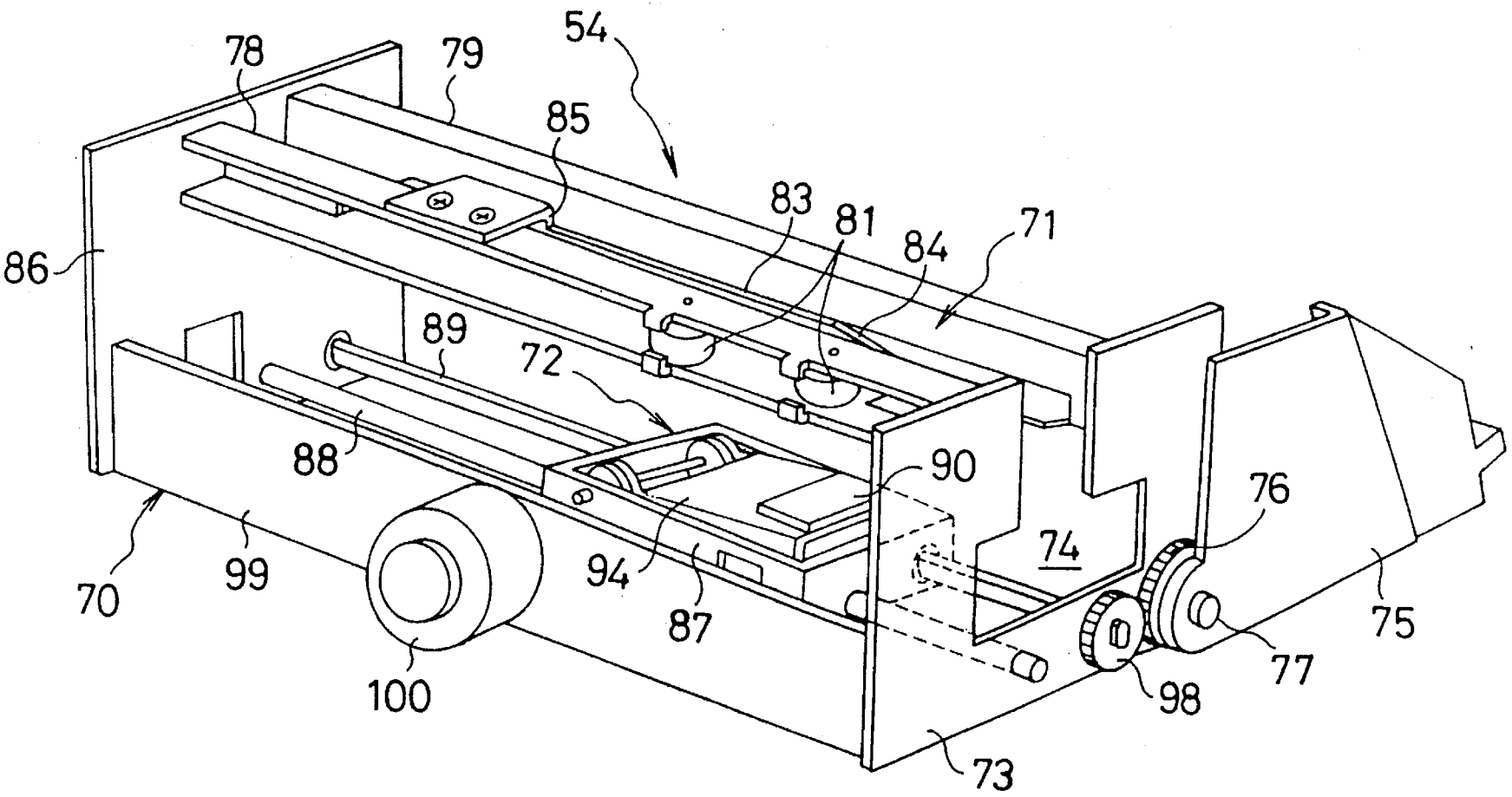
FIG. 10 is a perspective view showing a heat print portion of the heat print device.

In the right side wall 73 of the subframe 70 (as viewed in FIG. 6) is an opening 74 which has substantially the same shape as the cross-section of the lower half portion of the stamp unit 1 when viewed from a side. A sector gear 76 is fixedly provided to an opening and closing door 75 for opening and closing the opening 74. The opening and closing door 75 and the sector gear 76 are rotatably mounted on the right side wall 73 (as viewed in FIG. 10), of subframe 70 of the heat print device 50, by a pivot shaft 77. The upper portion of the subframe 70 is provided with a pair of parallel guide members 78,79 at the front and rear sides of the opening 74. The lower ends of the guide members 78,79 are provided with guide portions 80 which extend horizontally in parallel to and toward each other (FIG. 9).

A pair of right and left rollers 81 are provided to the guide member 78 at the front side through an elongated hole so as to be movable in the front-and-rear direction by a short distance, and these rollers 81 are urged rearwardly or toward the stamp unit 1, by the spring 82.

The guide bar 83 fixed to the guide member 78 at the front side is disposed at a middle position between the guide members 78,79. A tapered face 84 which inclines in a lower right direction is formed on the upper surface of the right end portion of the guide bar 83, and an engaging portion 85 for defining the left limit position of the stamp unit 1 is formed at the left end portion of the guide bar 83.

The stamp unit 1 is inserted through the opening 74, and the pair of front and rear guide members 80 engage the pair of front and rear guide grooves 15 of the grip portion 2 of the stamp unit 1, whereby the stamp unit 1 is supported by the pair of guide members 80 and the stamp unit 1 is urged rearwardly, that is, toward the rear of the heat print device 50, by the pair of rollers 81, at the urging of the spring 82, to be accurately positioned in the front and rear direction. Further, in a state where the stamp unit 1 abuts against the engaging portion 85, the roller 81, at the right side, is engaged with the engaging recess portion 16 of the grip portion 2, and the position of the stamp unit 1 in the right and left direction can be accurately set.

Figure 2:
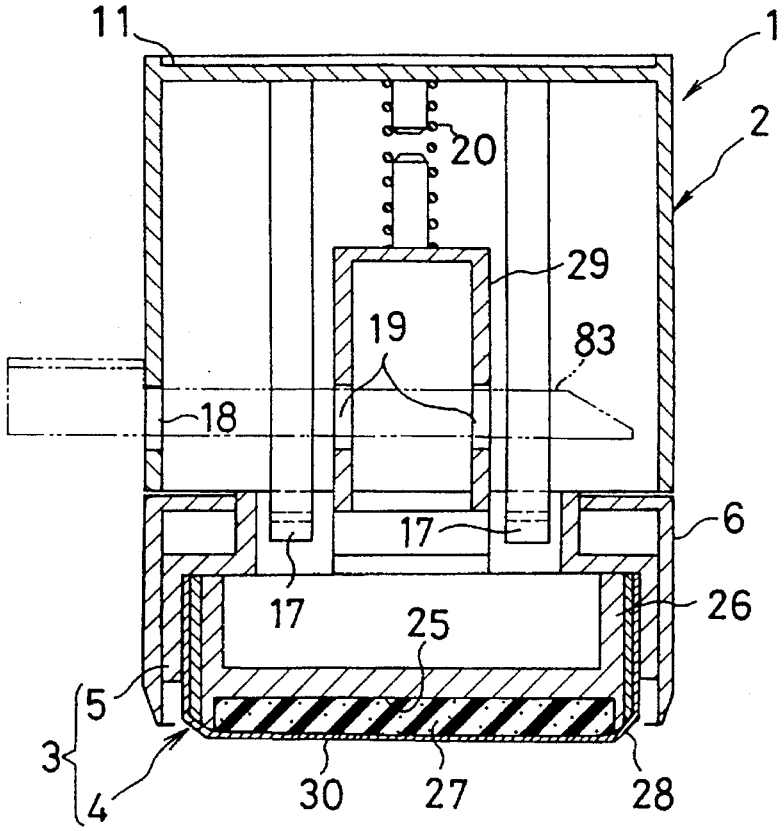
FIG. 2 is a longitudinal sectional front view of the stamp unit which shows a perforation-print state on the print face portion of the stamp unit.

When the stamp unit 1 is mounted on the print mount portion 71, the guide bar 83 is inserted through the guide holes 18, 19 of the stamp unit 1, whereby the skirt member 6 is upwardly moved and kept to the upper limit position shown in FIG. 2.

At the lower side of the print mount portion 71, is a guide rod 88 that extends in the right-and-left direction and guides a carriage 87. A head switching rod 89, extending in the right-and-left direction, operates a cam member 91 for switching the position of the thermal head 90 mounted on the carriage 87. Both rods 88,89 are suspended between the right end wall 73 and the left end wall 86 of the subframe 70. The cam member 91 is mounted on the head switching rod 89 so that it can not rotate but is slidable in the axial direction.

The carriage 87 is supported on the guide rod 88 and the head switching rod 89 so as to be movable in the right-and-left direction. A rack 92, extending the entire length of the carriage 87, is formed at the front end portion of the carriage 87.

A cam contact plate 93 and a head heat-radiating plate 94 are mounted on the carriage 87 by a shaft 95 extending transverse to the direction of movement of the carriage 87 so as to be pivotable in the up-and-down direction. The thermal head 90 is fixed to the head heat-radiating plate 94. The head heat-radiating plate 94 is elastically urged upwardly relative to the cam contact plate 93 by a spring 97 which is wound around a pin 96 fixed to the head heat-radiating plate 94.

The cam member 91 is designed in an elliptic shape and is in contact with the lower surface of the cam contact plate 93. When the cam member 91 is oriented to have its long axis parallel to shaft 95 (lateral attitude), by rotating the head switching rod 89, the thermal head 90 is released downwardly together with the head heat-radiating plate 94. When the cam member 91 is oriented to have its long axis perpendicular to shaft 95 (Fig. D) (erect attitude), the thermal head 90 is swung upwardly through the cam contact plate 93 and the spring 97 to a print position.

The right end portion of the head switching rod 89 (FIG. 11) is provided a gear 98 which is engaged with the sector gear 76 at the outside of the right end wall 73 of the subframe 70. When the opening and closing door 75 is opened, the cam member 91 is oriented to the lateral attitude. On the other hand, when the opening and closing door 75 is closed, the cam member 91 is moved to the erect attitude.

On the front wall 99 (FIGS. 9 and 10) of the subframe 70 are provided a stepping motor 100 for driving the carriage 87, a driving gear 101 engaged with the rack 92, and a decelerating mechanism 103 for transferring the rotation of an output gear 102 of an output shaft of the stepping motor 100 to the driving gear 101. Therefore,the rotational driving force of the stepping motor 100 is transferred to the driving gear 101, while decelerated and the carriage 87 can be driven by the stepping motor 100 to move in the right-and-left direction.

Figure 11:
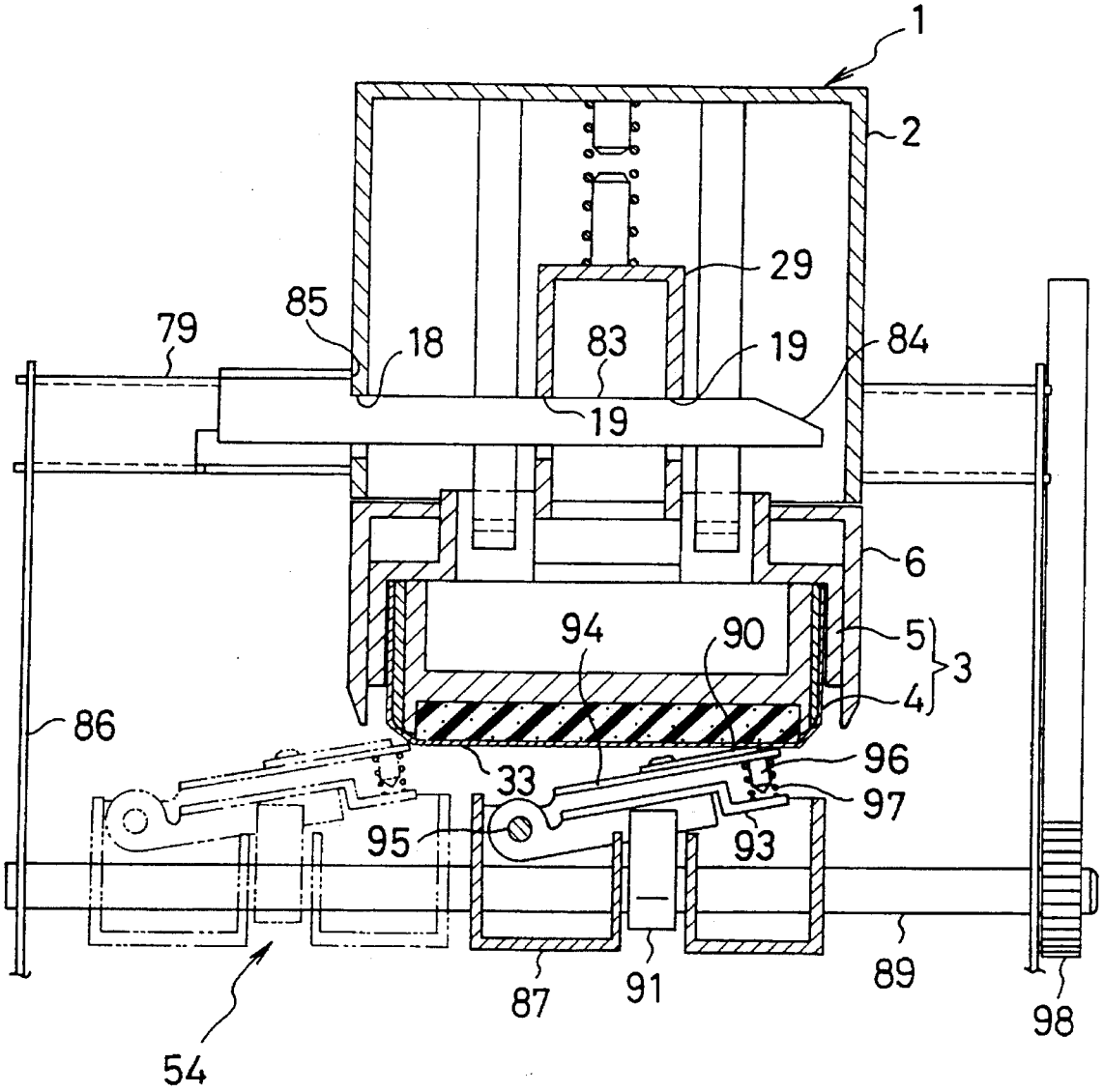
FIG. 11 is a longitudinal, sectional front view of the stamp unit after mounting on the print mount portion and the heat print portion.

The thermal head 90 is the same type as a thermal head of a heat printer and is provided with 96 heating elements which are arranged in a row in the front-and-rear direction (FIG. 11).

Figure 12:
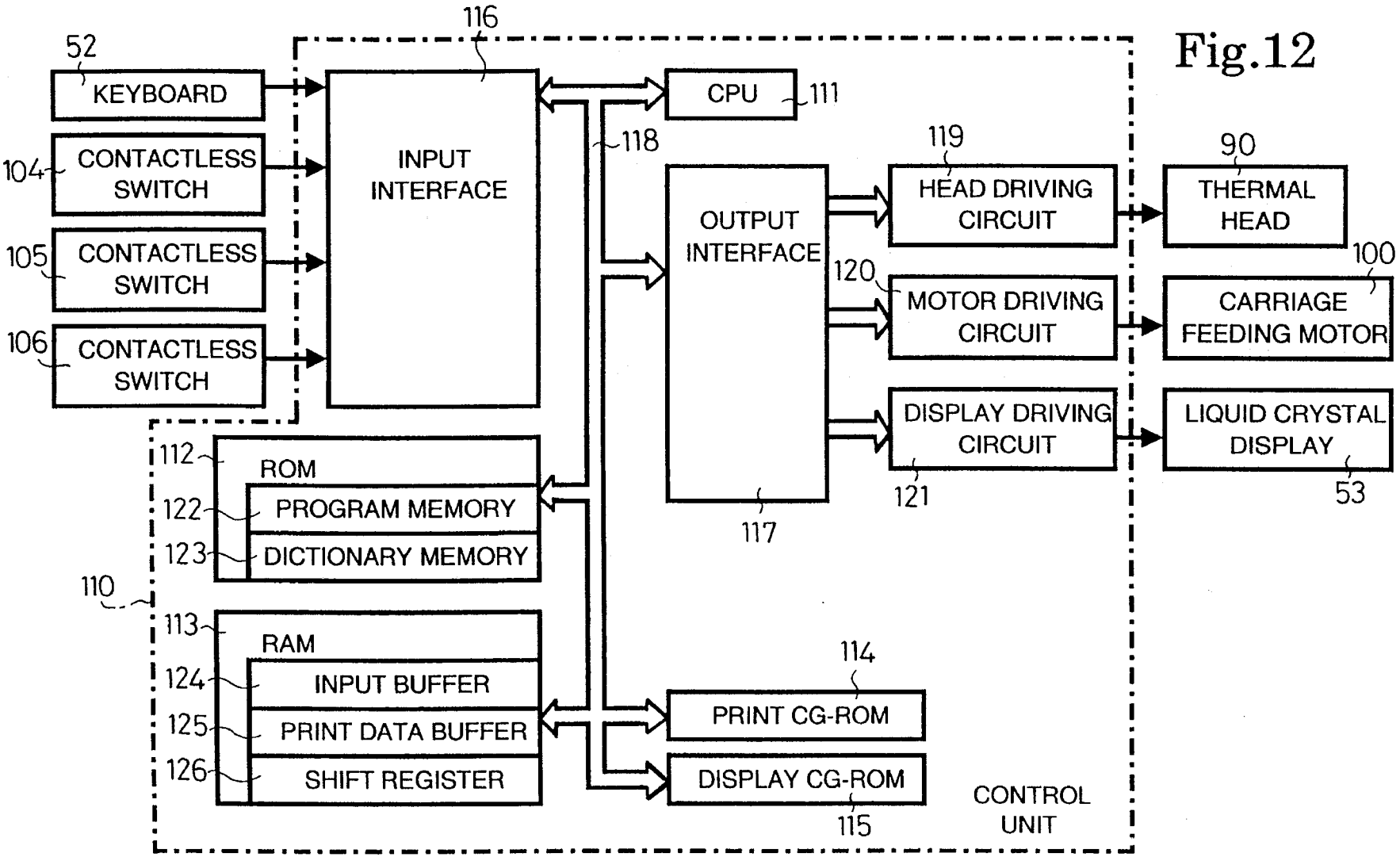
FIG. 12 is a block diagram showing a control system of the heat print device.

As shown in FIG. 12, the control unit 110 is connected to the keyboard 52, the thermal head 90, the carriage feeding motor 100, the liquid crystal display 53, two contactless switches 104,105 for detecting the presence of the stamp unit 1 and its width in the front-and-rear direction, and a contactless switch 106 for detecting the dummy stamp unit 130.

Figure 8:
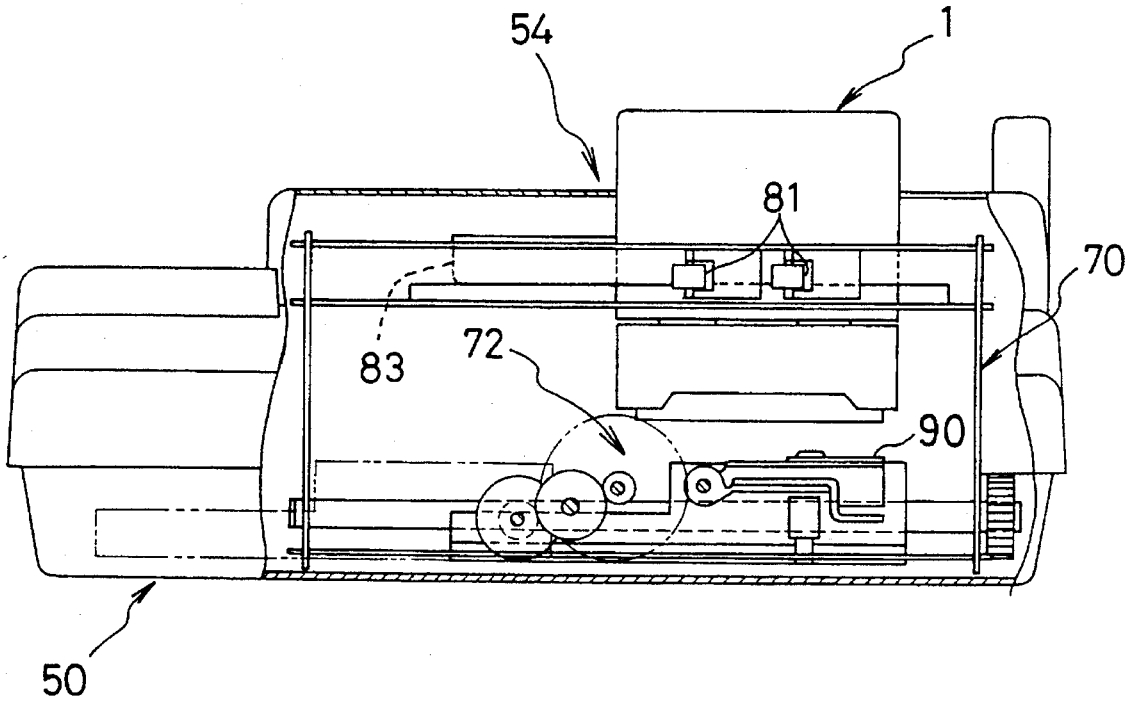
FIG. 8 is a front view of the heat print device which is partially cut out.

In this embodiment, there are two types of stamp units that can be used. A narrow-width type stamp unit 1 is indicated by a solid line of FIG. 9 and a wide-width type is indicated by a chain line. The two contactless switches 104,105 are provided to the lower wall portion of the guide member 79 at the rear side of the heat print device 50 as shown in FIGS. 7 to 9. The wide-width type of stamp unit 1 is detected by both of the contactless switches 104,105 and the narrow-width type of stamp unit 1 is detected only by the contactless switch 104. Further, the contactless switch 106, for detecting the dummy stamp unit 130, as described later, is disposed away from the contactless switch 104 to the left side of the heat print device 50 at a predetermined interval.

As shown in FIG. 12, the control unit 110 is provided with a CPU 111, a ROM 112, a RAM 113, a print CG-ROM 114, a display CG-ROM 115 for display on the display 53, an input interface 116 connected to the keyboard 52 and the contactless switches 104, 105 and 106, and an output interface 117. These elements are connected to one another through a bus 118. The control unit 110 is further provided with a head driving circuit 119, a motor driving circuit 120 and a display driving circuit 121 which are connected to the output interface 117.

The ROM 112 is provided with a program memory 122 storing a control program for controlling the operation of the heat print device 50 and a dictionary memory 123 for Kana/Kanji conversion or other data memory as appropriate.

The RAM 113 is provided with an input buffer 124 for storing input data, a print data buffer 125 for storing print dot pattern data, a shift register 126, and various other counters and registers. The print CG-ROM 114 contains dot pattern data of many character dots serving as a print target in correspondence with the code data and the display CG-ROM 115 stores display dot pattern data of many characters serving as a print target in correspondence with the code data.

Here, in the case where a desired character array is formed on the print face portion 30 of the stamp unit 1 by perforation, to complete the stamp unit for use as a stamp, upon input of the desired character array from the keyboard 52 of the heat print device 50 to the control unit 110, the print dot pattern for the mirror character array of the desired character array is prepared and stored in the control unit 110. Thereafter, the desired character array is tentatively printed on the heat sensitive sheet of the dummy stamp unit 130 for a check and, then, the perforation print is performed on the print face portion 30 by the control unit 110 and the heat print mechanism 72. After the perforation print of the character array on the print face portion 30, the ink of the impregnation member 27 may be ejected from the perforations of the character array and the character array can be printed many times like printing with an ordinary rubber stamp.

The dummy stamp unit 130 comprises a dummy stamp body 140 having a grip portion 141, which is grasped by the hand, and a body base portion 142, which is integrally formed at the lower end of the grip portion 141. A tape-shaped heat sensitive sheet 131 which is slightly wider than the print face portion 30 of the stamp unit 1, and a cover member 170, which is rotatably pivoted to the dummy stamp body 140. The tape-shaped heat sensitive sheet 131 has a heat sensitive sheet roll 131a whose outer surface side serves as a heat sensitive face.

The dummy stamp body 140 is formed of synthetic resin. The grip portion 141 is designed in a hollow shape. A slit groove 143 is provided through which the engaging member 83 of the heat print device 50, as described above with respect to stamp unit 1, is inserted. the slit groove 143 is formed at the center portion of a side wall of the grip portion 141. Further, a pair of guide grooves 144 are found in the front and rear walls of the grip portion 141, similar to the guide grooves 15 of the stamp unit 1 as described above.

The body base portion 142 is integrally linked to the lower end of the grip portion 141. The body base portion 142 comprises a platen forming portion 145 having substantially the same shape as the stamp portion 3 of the stamp portion body 4, a first extension portion 146 which extends from the left end of the platen forming portion 145 by a predetermined length, and a second extension portion 147 which extends from the right end of the platen forming portion 145 by a predetermined length.

A platen portion 150, to which a rectangular rubber sheet 149 is adhesively attached with adhesive agent 148, is formed on the lower surface of the platen forming portion 145 so as to be slightly wider and longer than the print face portion 30 of the wide type stamp unit 1.

The first extension portion 146 is formed with a lower-surface open type roll stock portion 151. The heat sensitive sheet roll 131*a* is mounted in the roll stock portion 151 so that the axial center thereof extends transverse to the direction of movement of carriage 87 and the lower side of the heat sensitive sheet roll 131*a* is covered with the cover member 170.

Figure 13:
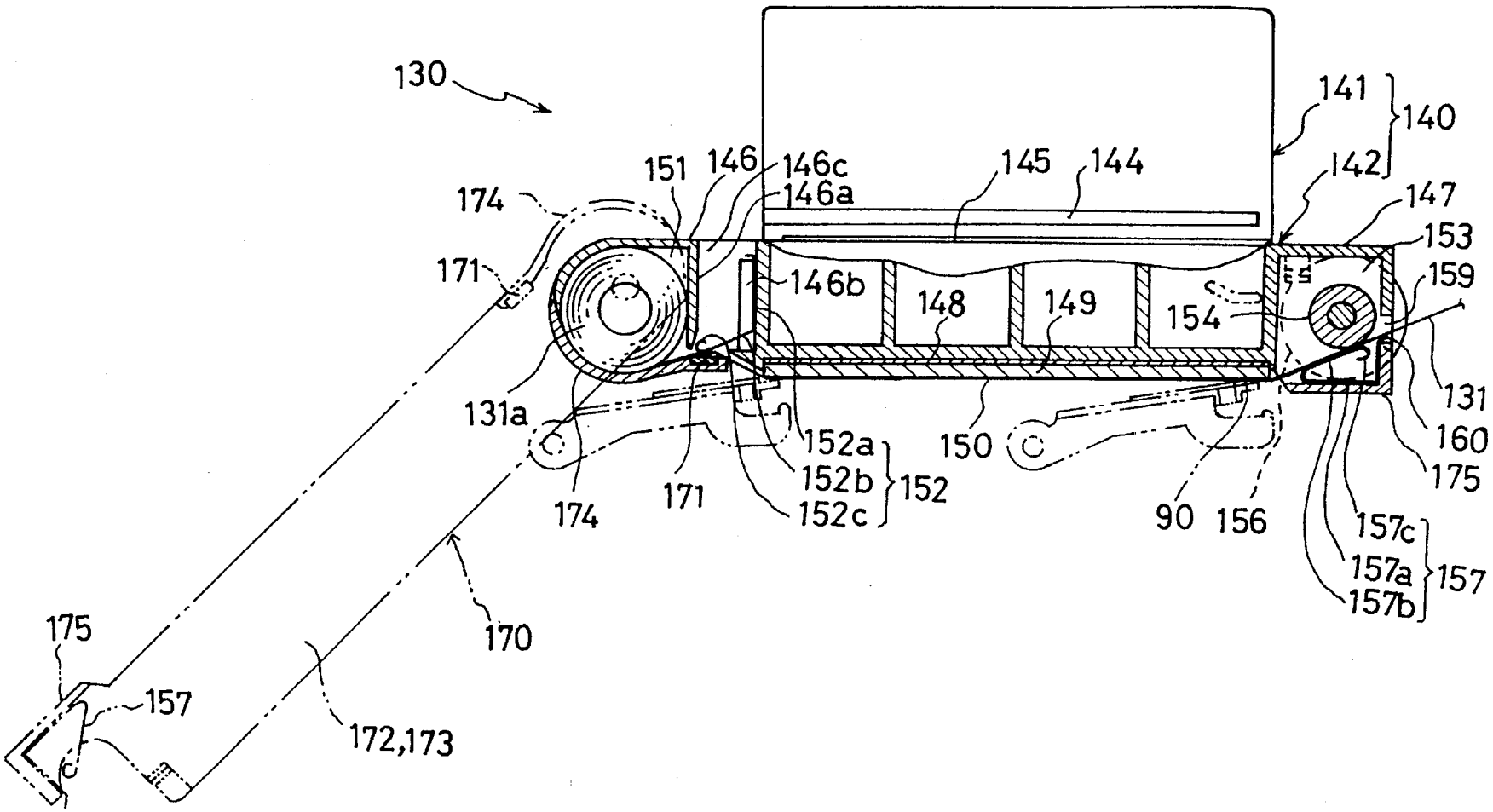
FIG. 13 is a longitudinally, partial sectional front view of the dummy stamp unit.

A securing portion 152*a* of a plate spring 152 for a sheet press is fixed to the right side wall (FIG. 13) of the first extension portion 146 and an urging portion 152*b* of the plate spring 152 is formed so as to be slanted to the lower left side. As indicated by a solid line of FIG. 13, the urging portion 152*b* is elastically urged toward a felt piece 171 of the cover member 170 in a state where the cover member 170 is closed, whereby, when the tape-shaped heat sensitive sheet 131 is drawn out from the heat sensitive sheet roll 131*a*, it is elastically pinched between a press portion 152*c* at the tip of the urging portion 152*b* and the felt piece 171 under a suitable elastic force to produce a suitable draw-out (take-out) resistance. Further, the dummy stamp unit 130 is further provided with two position restricting bars 146*a* for restricting the position of the heat sensitive sheet roll 131*a*, three ribs 146*b* which are inserted into the cut-out portions of the plate spring 152, and an opening 146*c* through which the plate spring 152 is mounted from the upper side.

A box-shaped roller stock portion 153 which is open at the lower end thereof is formed at the second extension portion 147. A roller 154, of rubber or similar material, is mounted in the roller stock portion 153 transverse to the direction of carriage 87 movement. A shaft 155 of the roller 154 is supported on the front and rear walls of the roller stock portion 153. Further, an operation knob 156 for rotationally operating the roller 154 is fixedly secured to the roller shaft 155 outside.

A plate spring 157 is provided at a portion of the cover member 170 which covers the lower side of the roller stock portion 153. The securing portion 157*a*, a L-shaped section of the plate spring 157, is fixed to the cover member 170. The urging portion 157*b*, of the plate spring 157, is formed slanted in the upper right direction (FIG. 13), and elastically urged toward the surface of the roller 154, whereby the tape-shaped heat sensitive sheet 131, which is guided from the heat sensitive sheet roll 131*a* across the surface of the platen portion 150 to the roller 154, is held by the elastic force between the press portion 157*c* at the tip of the urging portion 157*b* and the roller 154.

A clutch spring 158, that permits the rotational motion of the roller 154 only in a sheet feeding direction and inhibits the rotational motion thereof in the opposite direction, is mounted on a shaft portion of the operation knob 156. Accordingly, by manually rotating the operation knob 156 to rotate the roller 154 in the sheet feeding direction, the sheet feeding operation of the tape-shaped heat sensitive sheet 131 can be performed. The heat sensitive sheet 131 may be wound up by the roller 154.

An opening portion 159, through which the tape-shaped heat sensitive sheet 131 is guided to the outside of the dummy stamp unit 130, is formed between the right end wall of the second extension portion 147 and the right end wall of the cover member 170. A notched blade 160, formed at the right end portion of the plate spring 157 is disposed at the lower end of the opening portion 159. The notched blade 160 allows the tape-shaped heat sensitive sheet 131, extending from the opening portion 159, to be cut.

The cover member 170 is used to cover the lower side of the roll stock portion 151, both of front and rear sides of the body base portion 142 (FIG. 13) and the lower side of the roller stock portion 153. The cover member 170 can be opened and closed. The cover member 170 (FIG. 13) is preferably formed of a synthetic resin and has a front wall 172, a rear wall 173, a curved left-end side lower wall 174, for covering the lower side of the roll stock portion 151, and a right-end side lower wall 175 having L-shaped section, for covering the lower side of the roller stock portion 153, which are integrally formed with one another.

Figure 14:
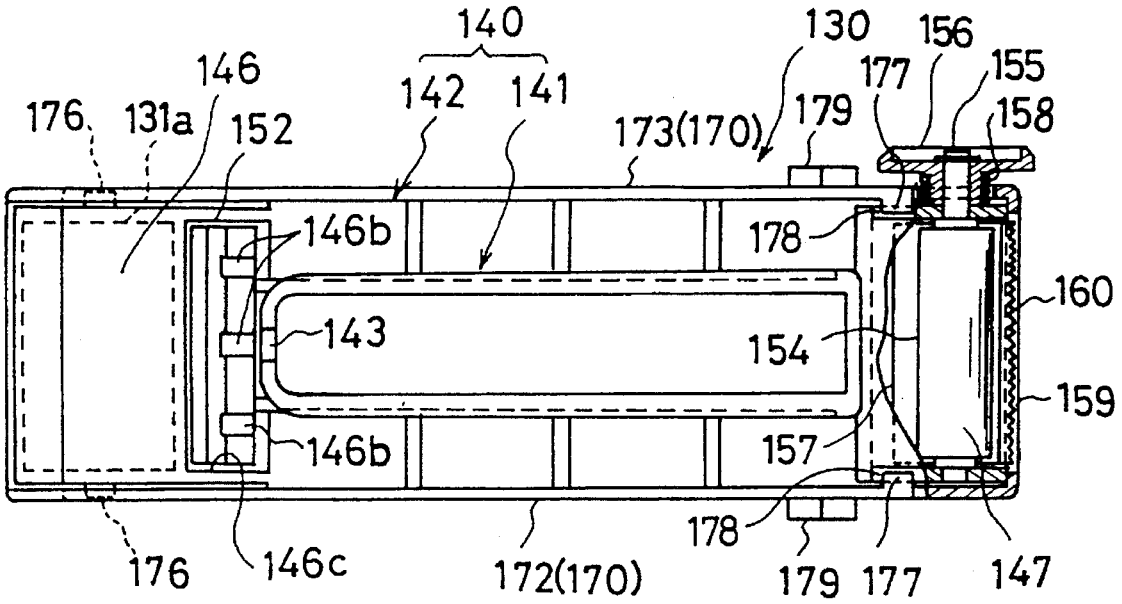
FIG. 14 is a plan view showing the dummy stamp unit.
Figure 15:
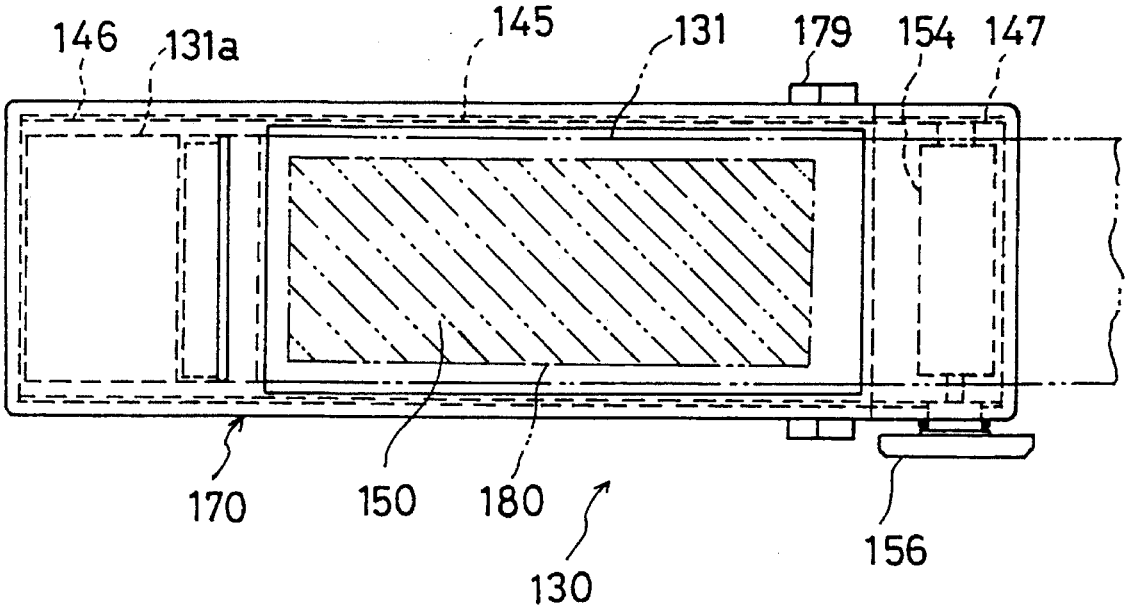
FIG. 15 is a bottom view of the dummy stamp unit.

Short pivot shafts 176 are integrally formed on the front and rear walls of the roll stock portion 151 (FIG. 14) so as to project from the walls. The pivot shafts 176 are engaged with a pair of pivot shaft support holes formed on the front wall 172 and the rear wall 173, toward the left end of the cover member 170. The pivot shafts 176 and pivot shaft support holes permit the cover member 170 to be freely swingable between a closed position as indicated by the solid line of FIG. 13 and an open position as indicated by the chain line of FIG. 13. By engaging a pair of engaging hooks of the front wall 172 and the rear wall 173 of the cover member 170 with step portions 178 of the front wall and the rear wall of the roller stock portion 153, the cover member 170 is retained in the closed position. Further, by manually manipulating a pair of projection pieces 179, which are provided so as to project from the outer surfaces of the front wall 172 and the rear wall 173 of the cover member 170, an opening and closing operation for the cover member 170 can be performed. The area indicated by the chain line of FIG. 15 corresponds to the print face portion 30 of the wide type of stamp unit 1.

In the dummy stamp unit 130 described above, the heat sensitive sheet roll 131*a* is first loaded into the roll stock portion 151 with the cover member 170 in the open position. The tape-shaped heat sensitive sheet 131 is drawn from the heat sensitive sheet roll 131*a*, extended across the surface of the platen portion 150, and guided past the roller 154 to the opening portion 159. Then the cover member 170 is closed. With the cover member 170 closed, the tape-shaped heat sensitive sheet 131 is pinched between the press portion 152*c* at the tip of the urging portion 152*b* and the felt piece 171 and between the press portion 157*c* at the tip of the urging portion 157*b* and the roller 154. In this state, the tape-shaped heat sensitive sheet 131 positioned on the surface of the platen portion 150 can be thermally printed by the thermal head 90 of the heat print device 50 when the dummy stamp unit 130 is installed in the heat print device 50.

The dummy stamp unit 130 is used to perform a tentative print operation with the thermal head 90 of the heat print device 50 prior to the perforation print operation of a character array on the print face portion 30 of the stamp unit 1.

Accordingly, before the data of a desired character array to be formed on the print face portion 30 of the stamp unit 1, through the perforation print, that is input from the keyboard 52 to the control unit 110, is perforated on the print face portion 30 of the stamp unit 1, the dummy stamp unit 130 is set on the print mount portion 71 of the heat print device 50, and a character array of normal characters (not mirror characters) is thermally printed on the tape-shaped heat sensitive sheet 131. Then the dummy stamp unit 130 is taken from the print mount portion 71 and the printed material reviewed.

When the thermally printed character array is the desired character array, no correction is required to the print dot pattern data. Therefore, a new stamp unit 1 which has not yet been perforated can be mounted on the heat print device 50 to perforate the print face portion 30 of the stamp unit 1.

On the other hand, when the thermally printed character array is not correct or not the desired character array, the data of the character array which has input can be corrected, or all new data input, and then printed to verify the data.

In this case, the character array to be tentatively thermally printed on the tape-shaped heat sensitive sheet 131 of the dummy stamp unit 130 is required to be a normal character array, not a mirror character array, and the character array to be perforation-printed on the print face portion 30 of the stamp unit 1 is required to be a mirror character array.

Accordingly, in the heat print device 50, according to a control program (FIGS. 18A,18B) as described later, the unit mounted on the print mount portion 71 is identified, that is, it is identified whether the stamp unit 1 or dummy stamp unit 130 is mounted on the print mount portion 71. If the mounted unit is the dummy stamp unit 130, a normal character array is thermally printed. On the other hand, if the mounted unit is the stamp unit 1, a mirror character array is printed on the print face portion 30 of the stamp unit 1 by perforating the print face portion 30.

Figure 18A:
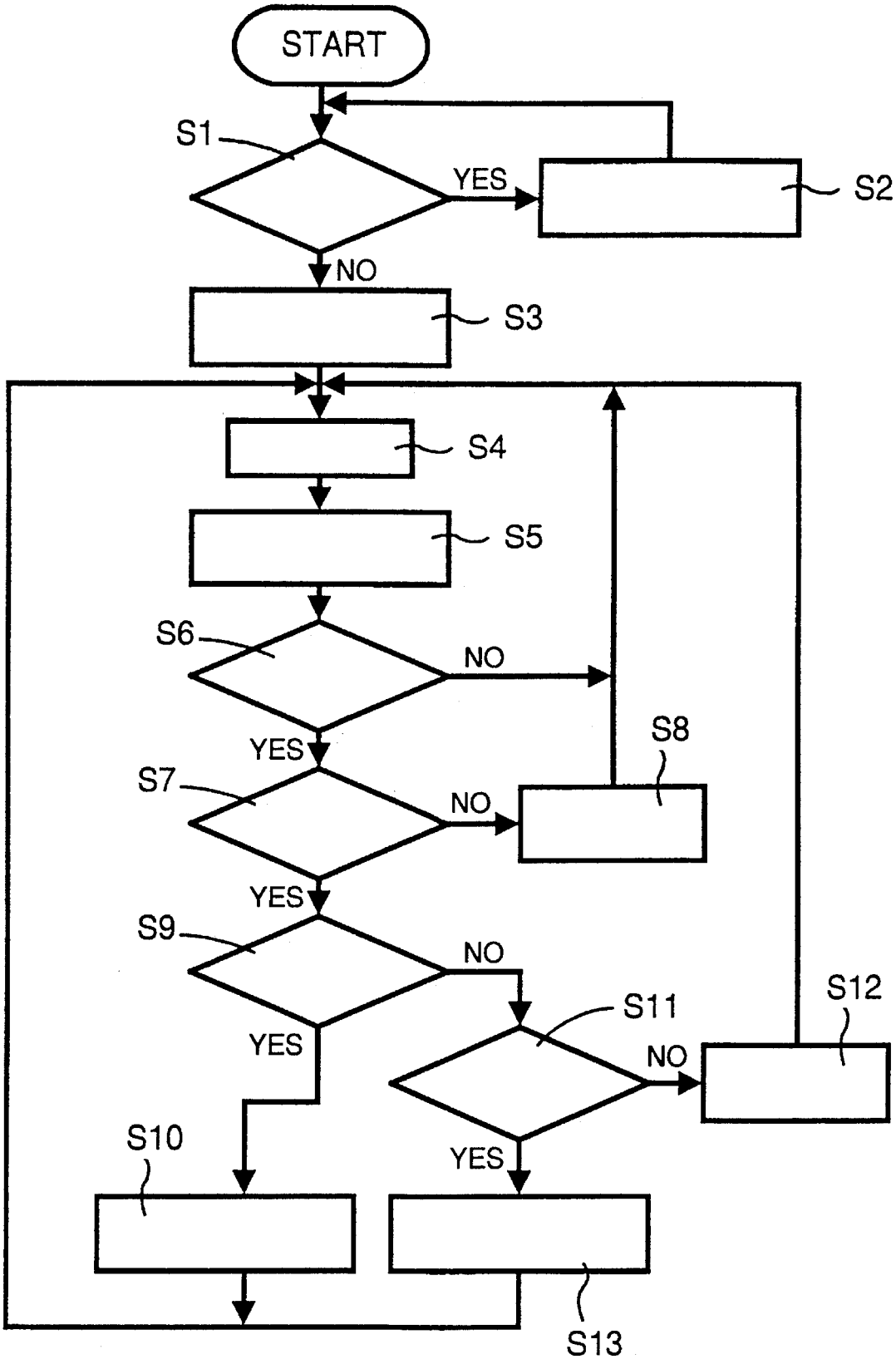
FIG. 18A is a flowchart for executing a control program by a control unit of the heat print device.

The control program will be described with reference to the flowchart of FIGS. 18A,18B in which reference character Si (i=1, 2, . . . ) represents a step.

Control is started by switching on the main switch 67 and it is judged, on the basis of a detection signal from the contactless switches 104 to 106, whether a medium (the dummy stamp unit 130 or stamp unit 1) is mounted on the print mount portion 71 (S1). If the medium has been mounted on the print mount portion 71 (Si: Yes), a message "Please take out medium" is displayed on the LCD 53 (liquid crystal display 53), and the control program returns to the step S1.

If a medium is not mounted (S1:No), the heat print device 50 is initialized and a message "In preparation" is displayed (S3). Subsequently, in step S4, input and/or print editing is performed, that is, data of a character array and a frame to be perforated on the print face portion 30 is input through the keyboard 52, and displayed on the LCD 53, by an operator. The input data are stored in an input buffer 124.

Subsequently, the print dot pattern data of the input character array are prepared on the basis of the input data stored in the input buffer 124, and then stored in the print data buffer 125 (S5).

Subsequently, the program waits for input of a print instruction signal from the print instruction switch 66. Upon input of the print instruction signal (S6: Yes), it is judged whether a medium has been mounted on the print mount portion 71. If a medium is judged not to be mounted (S7: No), a message "no medium" is displayed on the LCD 53 (S8). Thereafter, the program returns to the step S4. If a medium is mounted (S7: Yes), it is judged whether the medium mounted on the print mount portion 71 is the dummy stamp unit 130 (S9). If the detection signal from the contactless switch 106 is input, the medium is judged to be the dummy stamp unit 130 (S9:Yes).

Subsequently, in step S10, a character array of normal characters (not mirror characters) are thermally printed on the tape-shaped heat sensitive sheet 131 of the dummy stamp unit 130, and a message "under heat print" is displayed on the LCD 53 during the heat print operation. Further, a message "finished" is displayed on the LCD 53 when the heat printing is finished.

When the tape-shaped heat sensitive sheet 131 is thermally printed, the data of the print data buffer 125 are read out from the bottom address to the top address in the reverse direction and the heat print is executed while converting the stored print dot pattern data to the normal characters (not mirror characters). The program returns to the step S4 when step S10 is finished.

As described above, when the heat print on the heat sensitive sheet 131 of the dummy stamp unit 130 is finished, the operator removes the dummy stamp unit 130 from the print mount portion 71 and reviews the character array, the character size, the arrangement of the character array, and other appearance factors, on the basis of the printed character array which is printed on the heat sensitive sheet 131 (corresponding to a pattern to be printed on the surface of the sheet by the stamp unit 1). If the print state is unsatisfactory and must be corrected, editing is performed in step S4 to correct the input data of the character array and the frame. After the correction, in step S5, the dot pattern data for the print face portion are again prepared in the manner as described above, and the data in the print data buffer 125 are re-written, thereafter the program goes to step S6. On the other hand, if the print state is satisfactory, the program goes to step S6 through steps S4 and S5.

When the operator subsequently mounts the stamp unit 1 on the print mount portion 71, the program goes through steps S6 to S9 to step S11 to judge whether the print face portion size fits the stencil sheet (S11). This judgment is performed on the basis of the size data of the stencil sheet medium (data representing the wide type or the narrow type) which is input and stored during the input and/or editing step S4 and the detection signal from the contactless switches 104,105. If the judgment in the step S11 is "Yes", then perforation printing of the character array of mirror characters is performed on the print face portion 30 of the stamp unit 1 in step S13 and a message "under perforation print" is displayed on the LCD 53 during the perforation printing. Further, a message "finished" is displayed on the LCD 53 at the time when the perforation printing is finished. The program then returns to step S4.

At the perforation print time, the printing is performed while successively reading out data in a direction from the top address to the bottom address of the print data buffer 125 so that the character array of the mirror characters are perforatively printed.

On the other hand, if the judgment at the step S11 is "No", a message "print face portion size error" is displayed on the LCD 53 and the program returns to the step S4. Therefore, when the operator removes the stamp unit 1 from the print mount portion 71 and mounts thereon a stamp unit 1 whose print face portion size is satisfactory, the program goes to step S13 through steps S4 to S11 to execute the perforation printing on the print face portion 30. Thereafter the program returns to step S4.

In the heat print device 50 for the stamp unit of the stamp device as described above, the contactless switches 104 to 106 are provided to identify whether the medium mounted on the print mount portion 71 is the dummy stamp unit 130 or the stamp unit 1. On the basis of the detection signal of the contactless switches 104 to 106, a character array of normal characters is thermally printed on the heat sensitive sheet 131 of the dummy stamp unit 130 and a character array of mirror characters is perforatively printed on the print face portion 30 of the stamp unit 1.

Accordingly, the character array, the character size, and the arrangement of the character array or other presentation features can surely and properly be determined on the basis of the print state of the character array of the normal characters on the heat sensitive sheet 131. After the determination, the perforation print is performed on the print face portion 30 of the stamp unit 1 thereby avoiding erroneous or ineffective use of the stamp unit 1 by perforation printing of an incorrect character array on the print face portion of the stamp unit 1.

In the invention, the keyboard corresponds to input means, the RAM 113 of the control unit 110 corresponds to data storage means, the heat print mechanism 72 corresponds to heat print means, the contactless switches 104 to 106 correspond to identifying means and the control unit 110 corresponds to control means.

In the dummy stamp unit 130 of the above embodiment, the roller 154 is rotated by manipulating the operation knob 156 to feed the tape-shaped heat sensitive sheet 131 while the tape-shaped heat sensitive sheet 131 is sandwiched between the roller 154 and the press portion 157*c* at the tip of the urging portion 157*b*. However, in place of the roller 154, a member which is formed of a felt member or the like that pinches the tape-shaped heat sensitive sheet 131 in cooperation with the press portion 157*c* may be provided. In such a case, the tip of the tape-shaped heat sensitive sheet 131 which is exposed from the opening portion 159 is drawn out by the hand to feed the tape-shaped heat sensitive sheet 131.

According to the heat print device of the stamp unit, the print operation can be performed on the basis of the input data and the identifying data for identifying each of the dummy stamp unit and the stamp unit by providing the print mount portion, the input means, the input data storage means, the heat print means, the identifying means and the control means. With this structure, a character array of normal characters is thermally printed on the heat sensitive sheet of the dummy stamp unit while a character array of mirror characters is perforatively printed on the print face portion of the stamp unit.

Further, according to the heat print device for the stamp unit, the control means is designed to prepare print dot pattern data such that mirror characters are printed on the print face portion of the stamp unit while normal characters are printed on the heat sensitive sheet of the dummy stamp unit, and to thereby control the driving of the heat print means. Therefore, the normal characters are thermally printed on the heat sensitive sheet of the dummy stamp unit and mirror characters are perforatively printed on the print face portion of the stamp unit.

Accordingly, the character array, the character size, the arrangement of the character array, or other appearance features can be verified on the basis of the print state on the heat sensitive sheet of the dummy stamp unit. After the verification, perforation printing is performed on the print face portion of the stamp unit. Thus it is possible to prevent an incorrect character array from being perforatively printed and a stamp unit wasted.

What is claimed is:

1. A heat print device for a stamp unit in which a perforation print of dot pattern is conducted on a print face portion formed of heat sensitive stencil paper in a stamp unit or a thermal print of dot pattern is conducted on a heat sensitive sheet on the surface of a platen portion of a dummy stamp unit, including:

a print mount unit on which each of the stamp unit and the dummy stamp unit is selectively and detachably mounted;

input means for inputting characters and various commands;

data storing means for storing input data which are input from said input means;

heat print means containing a thermal head for performing a print operation in a dot pattern on the stamp unit or the dummy stamp unit which is mounted on said print mount unit;

identifying means for identifying whether a medium mounted on said print mount unit is the stamp unit or the dummy stamp unit; and control means for controlling the print operation of said heat print means on the basis of the input data received from said data storing means and the identification data received from said identifying means.

2. The heat print device as claimed in claim 1, wherein said control means prepares print dot pattern data with which mirror characters are printed on the print face portion of the stamp unit and normal characters are printed on the heat sensitive sheet of the dummy stamp unit to thereby control the driving operation of said heat print means.

3. The heat print device as claimed in claim 2, wherein said input means is a keyboard.

4. The heat print device as claimed in claim 2, wherein said print mount unit has a detector for identifying which of the dummy stamp unit and the stamp unit is detachably mounted.

5. The heat print device as claimed in claim 4, wherein said stamp unit is one of at least two widths and said detector can distinguish a width of the stamp unit.

6. The heat print device as claimed in claim 5, further comprising width error detection means, wherein said width error detection means determines that the width of the stamp unit is insufficient for printing the input characters.

7. A print stamp creation device, comprising:

a print unit having a stamp unit receiving section and a thermal printing unit;

a dummy stamp unit; and a print stamp unit, wherein either one of said dummy stamp unit or said print stamp unit can be mounted in said stamp unit receiving section.

8. The print stamp creation device according to claim 7, wherein said print unit has a detector for identifying which of the dummy stamp unit and the print stamp unit is mounted therein.

9. The print stamp creation device according to claim 8, wherein said dummy stamp unit has an elongated web thermal print medium opposing said print unit when mounted in said stamp unit receiving section.

10. The print stamp creation device according to claim 9, further comprising a control unit for controlling operation of the print unit; and input means for inputting character data and operating commands.

11. The print stamp creation device according to claim 10, wherein when the detector detects the presence of the dummy stamp unit, the control unit controls the thermal printing unit to normally print the character data input via the input means on the elongated web thermal print medium.

12. The print stamp creation device according to claim 8, wherein said print stamp unit has a stencil print medium opposing said print unit when mounted in said stamp unit receiving section.

13. The print stamp creation device according to claim 12, further comprising:

a control unit for controlling operation of the print stamp creation device; and input means for inputting character data and operating commands.

14. The print stamp creation device according to claim 13, wherein when said detector detects said print stamp unit is mounted in said stamp unit receiving section, the control unit controls the thermal printing unit to perforate the stencil such that print on the stencil print medium is a mirror image of the input character data.

15. The print stamp creation device according to claim 12, wherein said print stamp unit is one of at least two widths.

16. The print stamp creation device, as claimed in claim 15, wherein said detector can distinguish a width of the print stamp unit.

17. The print stamp creation device according to claim 16, further comprising width error detection means, wherein said width error detection means determines that the width of the print stamp unit is insufficient for printing the input character data.

18. The print stamp creation device according to claim 8, wherein said dummy stamp unit has an elongated web thermal print medium and said print stamp unit has a stencil print medium, said elongated web thermal print medium and said stencil print medium opposing said print unit when mounted in said stamp unit receiving section.

19. The print stamp creation device according to claim 18, wherein said detector determines which of said dummy stamp unit and said print stamp unit is mounted in said stamp unit receiving section and, based upon said detection, said control unit controls said thermal printing unit to print normal characters on said elongated web thermal print medium and mirror images on said stencil print medium.

20. The print stamp creation device according to claim 19, further comprising editing means for editing input data on a basis of an unsatisfactory print result on the elongated web thermal print medium.

* * * * *